US009984810B2

(12) United States Patent
Yamamoto et al.

(10) Patent No.: US 9,984,810 B2
(45) Date of Patent: May 29, 2018

(54) REACTOR

(71) Applicants: AutoNetworks Technologies, Ltd., Yokkaichi, Mie (JP); Sumitomo Wiring Systems, Ltd, Yokkaichi, Mie (JP); Sumitomo Electric Industries, Ltd., Osaka (JP)

(72) Inventors: Shinichirou Yamamoto, Mie (JP); Kazuhiro Inaba, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 0 days. days.

(21) Appl. No.: 15/313,333

(22) PCT Filed: Jun. 1, 2015

(86) PCT No.: PCT/JP2015/065816
§ 371 (c)(1),
(2) Date: Nov. 22, 2016

(87) PCT Pub. No.: WO2015/186674
PCT Pub. Date: Dec. 10, 2015

(65) Prior Publication Data

US 2017/0194087 A1 Jul. 6, 2017

(30) Foreign Application Priority Data

Jun. 6, 2014 (JP) ..... 2014-117768

(51) Int. Cl.
*H01F 27/29* (2006.01)
*H01F 27/28* (2006.01)
(Continued)

(52) U.S. Cl.
CPC ..... *H01F 27/2823* (2013.01); *H01F 1/14741* (2013.01); *H01F 1/14766* (2013.01); *H01F 27/255* (2013.01); *H01F 27/29* (2013.01)

(58) Field of Classification Search
CPC ..... H01F 27/00–27/36
(Continued)

(56) References Cited

U.S. PATENT DOCUMENTS

2012/0206232 A1 8/2012 Yamamoto et al.
2015/0287525 A1* 10/2015 Yamada ..... H01F 37/00 323/271
2015/0352965 A1* 12/2015 Inaba ..... H01F 37/00 363/131

FOREIGN PATENT DOCUMENTS

JP 2005109384 A * 4/2005
JP 2009302360 A 12/2009
(Continued)

*Primary Examiner* — Tuyen Nguyen
(74) *Attorney, Agent, or Firm* — Dinsmore & Shohl LLP

(57) ABSTRACT

Provided is a reactor having a small installation area, low loss, and excellent productivity. The reactor includes a coil having a pair of winding portions and that are arranged side by side, and a magnetic core having a U-shaped core piece that is part of a powder compact. The U-shaped core piece includes a side base that has a portion opposite the ends of the pair of winding portions and uncovered by the winding portions, and disposed across the pair of winding portions, a pair of middle portions that protrude from the side base and respectively disposed inside the pair of winding portions, and an end surface facing a gap, a side extension portion extending from the side base orthogonally from the middle portions, and a central protruding portion protruding from the side base's central region, and are arranged side by side, away from the middle portions.

12 Claims, 8 Drawing Sheets

(51) Int. Cl.
*H01F 27/255* (2006.01)
*H01F 1/147* (2006.01)

(58) Field of Classification Search
USPC ... 336/65, 83, 196, 198, 200, 212, 220–223, 336/232–234
See application file for complete search history.

(56) References Cited

FOREIGN PATENT DOCUMENTS

| | | | |
|---|---|---|---|
| JP | 2011119664 | A | 6/2011 |
| JP | 2013168538 | A | 8/2013 |
| JP | 2014196400 | A | 10/2014 |
| JP | 2015005579 | A | 1/2015 |
| WO | 2014069311 | A1 | 5/2014 |

* cited by examiner

3:31m, 31g, 32m

REACTOR

CROSS-REFERENCE TO RELATED APPLICATIONS

This application is the U.S. national stage of PCT/JP2015/065816 filed Jun. 1, 2015, which claims priority of Japanese Patent Application No. JP 2014-117768 filed Jun. 6, 2014.

FIELD OF THE INVENTION

The present invention relates to a reactor used for a constituent component or the like of an in-vehicle DC-DC converter or a power conversion device installed in a vehicle such as a hybrid automobile. In particular, the present invention relates to a reactor that has a small installation area, low loss, and excellent productivity.

BACKGROUND

A reactor is one type of component of a circuit for increasing or reducing voltage. JP 2011-119664A discloses a reactor including a coil in which a pair of winding portions (a coil element) obtained by helically winding a winding wire are arranged side by side, and an annular magnetic core formed by combining a plurality of core pieces, as a reactor used for a converter installed in a vehicle such as a hybrid automobile.

The magnetic core disclosed in JP 2011-119664A includes middle core pieces disposed inside the winding portions, end core pieces that are not covered by the winding portions and in which a coil is not disposed, and gap members that are interposed between adjacent core pieces. A surface of the end core piece that is opposite to an installation target when the reactor is attached to the installation target protrudes further toward the installation target than a surface of the middle core piece that is opposite to the installation target, and serves as an installation surface. As a result of a decrease in the thickness in the axial direction of the winding portions caused by this protrusion, the end core piece can reduce the installation surface. Also, all of the middle core pieces and the end core pieces are powder compacts, and these core pieces are independent members, making the core pieces into a simple three dimensional shape such as a cuboidal shape.

A reactor is desirable that has a small installation area, low loss, and excellent productivity.

As described above, the length in the axial direction of the winding portions in the reactor decreases due to the shape in which the end core pieces further protrude than the middle core pieces, resulting in the reactor having a small installation area. However, since the end core pieces and the middle core pieces are independent from each other, the number of assembling components will increase, the number of steps will increase, and the productivity of reactors will decrease. Because a surface of the end core piece that joins the middle core piece is a uniform flat surface, a difficulty in positioning of these core pieces will also reduce the productivity.

Also, if gaps are provided between the end core pieces and the middle core pieces, magnetic flux leaks from gap portions to protruding portions of the end core pieces. If this magnetic flux leak intersects the coil, loss such as copper loss may increase. In the reactor of JP 2011-119664A, in order to reduce this loss, a relative magnetic permeability of the gap members is greater than 1 and less than 1.5.

However, the number of steps of manufacturing these specific gap members will increase, and the productivity of reactors will decrease.

The present invention has been made in view of the above-described circumstances, and it is an object thereof to provide a reactor that has a small installation area, low loss, and excellent productivity.

SUMMARY OF INVENTION

A reactor according to an aspect of the present invention includes a coil having a pair of winding portions that are obtained by helically winding a winding wire and that are arranged side by side, and a magnetic core having a U-shaped core piece that is part of a powder compact. The U-shaped core piece includes a side base that has a portion opposite to an end surface of the pair of winding portions, is not covered by the winding portions, and is disposed across (bridging) the pair of winding portions, a pair of middle portions that protrude from the side base to be respectively disposed inside the pair of winding portions, and have an end surface facing a gap, a side extension portion extending from the side base in a direction intersecting an axial direction of the middle portions, and a central protruding portion that protrudes from the side base's central region, with respect to a direction in which the pair of middle portions are arranged side by side, away from the middle portions.

The above-described reactor has a small installation area, low loss, and excellent productivity.

DETAILED DESCRIPTION OF THE PREFERRED EMBODIMENTS

Figure 1:
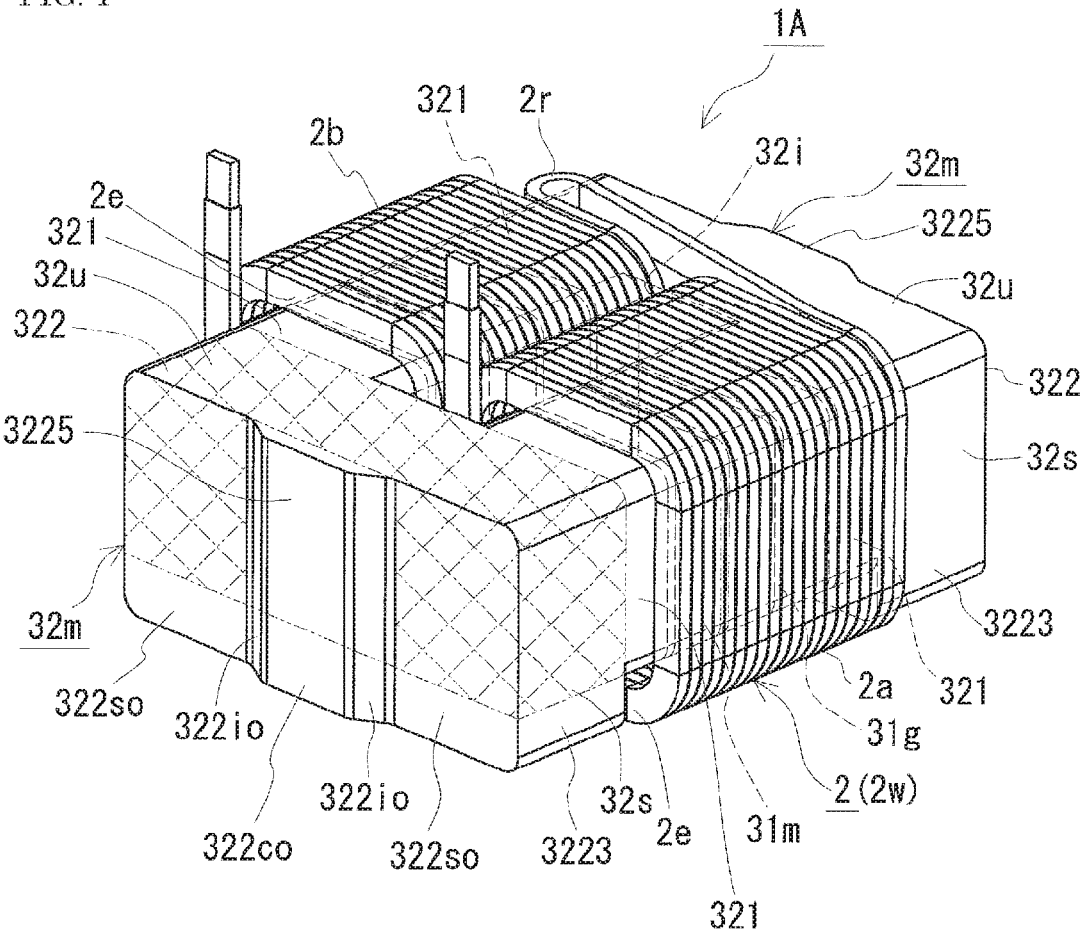
FIG. 1 is a schematic perspective view showing a reactor of Embodiment 1.

Description of Embodiments of the Present Invention

First, embodiment of the present invention will be listed.

(1) A reactor according to an aspect of the present invention includes a coil having a pair of winding portions obtained by helically winding a winding wire arranged side by side, and a magnetic core having a U-shaped core piece that is part of a powder compact. The above-described U-shaped core piece includes a side base that has a portion opposite to end surfaces of the pair of winding portions, is not covered by the winding portions, and is disposed across the pair of winding portions, a pair of middle portions that protrude from the side base to be disposed in the pair of winding portions and have end surfaces facing gaps, side extension portions extending from the side base in directions intersecting the axial direction of the middle portions, and a central protruding portion that protrudes from the side base's central region, with respect to a direction in which the pair of middle portions are arranged side by side, away from the middle portions.

Because the above-described reactor includes a specific U-shaped core piece, the reactor has a small installation area, low loss, and excellent productivity due to the following reasons.

Reason why Installation Area is Small

Because the above-described reactor includes the side extension portion, compared to the case where the same magnetic path cross-sectional area is secured without the side extension portion, the length in the axial direction of the winding portions in the side base of the U-shaped core piece (hereinafter, referred to as thickness) can be shortened. As a result, a surface parallel with the axial direction of the winding portions of the U-shaped core piece is an installation surface opposite to an installation target when the reactor is attached to the installation target, an installation surface of the U-shaped core piece has a short length in the axial direction of the winding portions, reducing an installation area. Thus, the above-described reactor has a small installation area.

Reason for Low Loss

In the above-described reactor, an end surface facing a gap provided between the U-shaped core piece and another core piece in the middle portion of the U-shaped core piece is disposed inside the winding portions by inserting the middle portion into the winding portions of the coil. Therefore, in the above-described reactor, the gap provided between the core pieces constituting a magnetic core can be disposed inside the winding portions. Because borders between the winding portions of the coil and portions at which the winding portions are not present, such as between the above-described middle core pieces and the end core pieces, are not provided with gaps, loss caused by magnetic flux leaking from gaps of these borders does not occur, and thus the above-described reactor has low loss.

Reason for Good Productivity

Because the above-described reactor includes the U-shaped core piece integrally including the middle portion and the side base as a constituent element, compared to the case where the above-described middle core pieces and the above-described end core pieces are separate members, the number of assembling components decreases, the number of steps can be reduced, and the reactor has excellent productivity. Also, as described above, the gap can be disposed inside the winding portions of the coil, the reactor has excellent productivity in that it does not require preparation for a specific gap member to be disposed at the above-described borders.

In particular, because the reactor includes the central protruding portion, in the plan view of the U-shaped core piece, the thickness (a thickness $T_A$ that will be described later, FIG. 3) of a central region including the central protruding portion are arranged side by side in a direction in which the middle portions and the thickness (a thickness $T_B$ that will be described later, FIG. 3) of regions located on both sides of the central region (left and right regions) can be easily made equal to each other. If a powder compact (a U-shaped core piece) having such a shape is manufactured, the axial direction of the middle portions is a pressing direction, and the thickness of powder that is supplied is adjusted such that the thicknesses of the above-described regions in the powder compact are in specific ranges. As a result, a difference in density of the above-described regions, unevenness of the density in the vicinity of borders of the above-described regions, and the like are unlikely to occur. Therefore, it is possible to stably manufacture a powder compact having an even density with precision. Also, compared to the case where a direction orthogonal to the axial direction of the middle portion is used as the pressing direction, using the axial direction of the middle portion as the pressing direction makes it possible to stably manufacture a powder compact having a side extension portion with precision. The reactor has excellent productivity in this respect.

(2) One example of the reactor is an embodiment in which the side extension portion extends in a direction toward the installation target of the above-described intersection directions when the reactor is attached to the installation target, and a surface opposite to the installation target of the side extension portion is an installation surface.

In this embodiment, since the side extension portions of the U-shaped core piece extend toward the installation target, compared to the case where the same magnetic path cross-sectional area is secured without the side extension portions, the thickness of the side base can be reduced. Also, in this embodiment, compared to the case where the side extension portions extend in a direction in which the winding portions are arranged side by side, of the above-described intersection directions, the length (hereinafter, referred to as a width) of the reactor in the direction in which the winding portions are arranged side by side can also be reduced. Here, for example, if the side extension portions protrude from an outer circumferential surface of the coil in the side-by-side arranging direction, the thickness of the U-shaped core piece can be reduced, but the width increases. When the reactor is installed, it is necessary to secure a space including the protruding portions in this side-by-side arranging direction. Therefore, in this case, it is difficult to sufficiently reduce the installation area. In contrast, in the above-described embodiment, both the thickness and the width of the U-shaped core piece can be reduced, and the installation area is much smaller. Also, in the above-described embodiment, the reactor can be stably attached to the installation target due to the U-shaped core piece having an installation surface, and has excellent heat releasing capability because the U-shaped core piece can be utilized for a heat releasing path of a coil that generates heat when used.

(3) One example of the reactor according to (2) above is an embodiment in which the side extension portions also extend in a direction away from the installation target of the above-described orthogonal directions.

In the above-described embodiment, since the side extension portions extend in both a direction in which the side extension portions come close to the installation target and a direction in which the side extension portions separate from the installation target, compared to the case where the same magnetic path cross-sectional area is secured without this side extension portions, the thickness of the side base can also be more reduced and the width can also be reduced as described above. Therefore, in the above-described embodiment, if a surface parallel with the axial direction of the winding portions in the U-shaped core piece is an installation surface, the installation area can be reduced further.

(4) One example of the above-described reactor is an embodiment in which when a sum of the thickness of the side base along the axial direction of the middle portion and a length by which the central protruding portion protrudes is a thickness $T_A$, and a sum of a protruding length along the axial direction of the middle portion and a thickness of the side base is a thickness $T_B$, then a thickness ratio $T_A/T_B$ is at least 0.5 and not more than 2.

Because the thickness $T_A$ of the central region including the central protruding portion and the thickness $T_B$ of regions (left and right regions) on both sides that do not include the central protruding portion are in specific ranges, or preferably, they are equal to each other, the U-shaped core piece of the powder compact can be stably manufactured with precision as described above and the above-described embodiment has excellent productivity.

(5) One example of the above-described reactor is an embodiment in which when a length from a side surface of the side base along the direction in which the pair of middle portions are arranged side by side to a side edge of the central protruding portion is a width $W_{1S}$, and a length of the central outer end surface of the central protruding portion parallel with the direction in which the pair of middle portions are arranged side by side is a width $W_{1C}$, a length of each of the middle portions along the direction in which the pair of middle portions are arranged side by side is a width $W_{2S}$, and a length between the pair of middle portions along the direction in which the pair of middle portions are arranged side by side is a width $W_{2C}$, then a ratio of inner and outer widths $(W_{1S}/W_{1C})/(W_{2S}/W_{2C})$ is at least 0.8 and not more than 1.25.

It can be said that in the U-shaped core piece included in the above-described embodiment, in the plan view, the above-described ratios of the width of the central region and the widths of the left and right regions on the side closer to the coil (hereinafter, also referred to as an inner side) and on the side away from the coil (hereinafter, also referred to as an outer side) have an equal ratio or about an equal ratio. That is, the shape of unevenness on the side closer to the coil (the shape caused by the middle portions that protrude toward the coil) and the shape of unevenness on the side away from the coil (the shape caused by the central protruding portion that protrudes away from the coil) substantially correspond to each other. In the powder compact (the U-shaped core piece) having such a specific shape, as described above, when the axial direction of the middle portions is a pressing direction, a pressing force for the above-described central region and a pressing force for the left and right regions can be easily made uniform. That is, in this powder compact, the inner shape and the outer shape of the U-shaped core piece are step shapes, but they are in a state of substantially a corresponding step. Therefore, the powder compact having a predetermined shape and size can be molded precisely, and has excellent moldability. Also, a difference in density between the above-described central region and the left and right regions can be reduced, and the U-shaped core piece can be stably manufactured. Therefore, the above-described embodiment is more excellent in the productivity of the reactor. In this embodiment, it is preferable that the above-described thickness ratio $T_A/T_B$ is at least 0.5 and not more than 2.

(6) One example of the reactor according to (5) above is an embodiment in which both a ratio of the left and right widths $(W_{1S}/W_{2S})$ and a ratio of the central widths $(W_{1C}/W_{2C})$ are at least 0.8 and not more than 1.25.

In the U-shaped core piece included in this embodiment, in the plan view, the shape of unevenness on the side closer to the coil and the shape of unevenness on the side away from the coil are more equal to each other, and the U-shaped core piece has more excellent moldability. Therefore, the above-described embodiment is more excellent in the productivity of the reactor.

(7) One example of the above-described reactor is an embodiment in which at least one corner of the above-described U-shaped core piece is subjected to R-chamfering or C-chamfering.

Compared to a sharp corner having a right angle, the above-described embodiment has excellent moldability and excellent capability of being removed from a mold, can easily suppress cracks of a corner when the U-shaped core piece is molded or attached to the coil, for example, and has excellent productivity.

Hereinafter, a reactor according to an embodiment of the present invention will be specifically described with reference to the drawings. The same reference signs in the drawings indicate an object having the same name.

Embodiment 1

A reactor 1A of Embodiment 1 will be described with reference to FIGS. 1 to 6. Hereinafter, when the reactor 1A shown in FIG. 1 is attached to an installation target (not shown) such as a converter case, a lower surface in FIG. 1 is regarded as a surface opposite to the installation target (an installation surface that is in contact with the installation target in some cases). This installation state is merely an example, and another surface sometimes serves as a surface opposite to the installation surface.

Reactor

Overall Configuration

Figure 7:
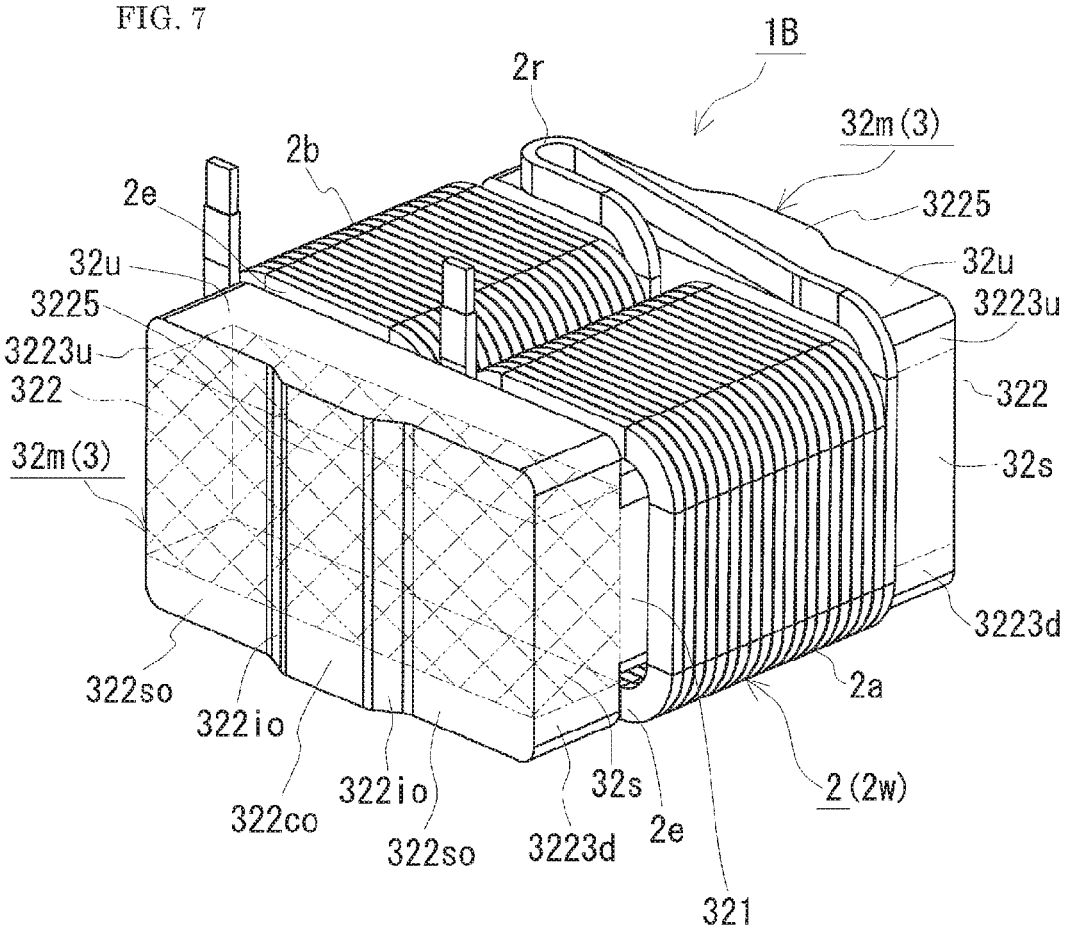
FIG. 7 is a schematic perspective view shown in a reactor of Embodiment 2.
Figure 8:
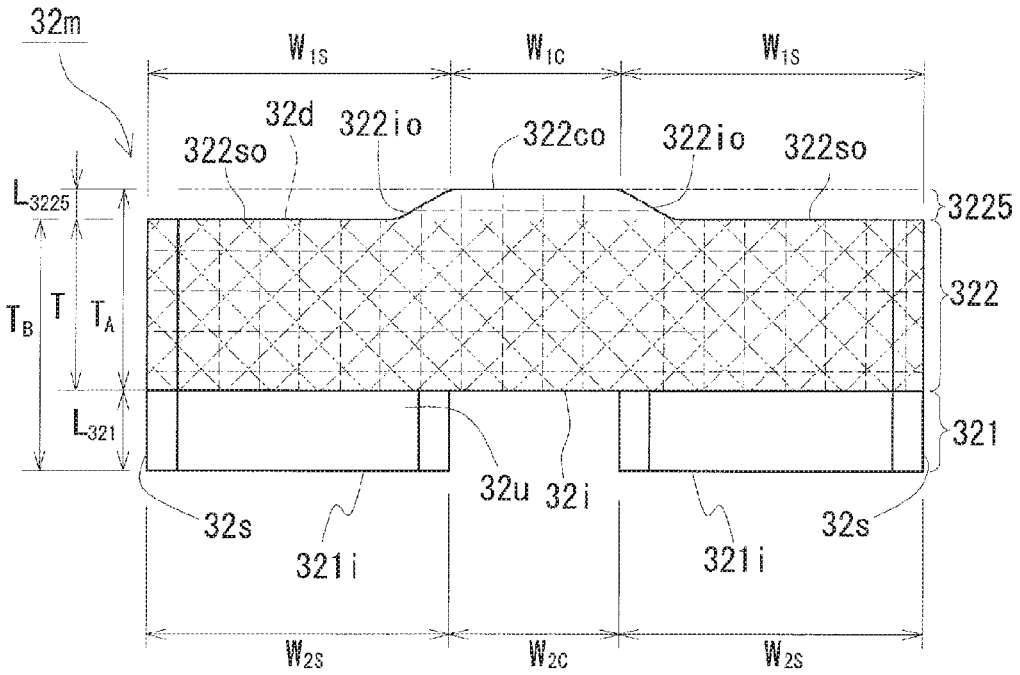
FIG. 8 is a plan view of a U-shaped core piece provided in the reactor of Embodiment 2.

The reactor 1A includes a coil 2 obtained by helically winding a winding wire 2*w*, and a magnetic core 3 that is disposed inside and outside the coil 2 and forms a closed magnetic circuit. The magnetic core 3 includes a plurality of core pieces 31*m* . . . disposed inside the coil 2, and a pair of U-shaped core pieces 32*m* and 32*m* around which the coil 2 is not substantially disposed and that has a portion exposed from the coil 2. One of the characteristics of the reactor 1A is that the core pieces 32*m* are constituted by the powder compacts having a specific shape. Briefly, the core pieces 32*m* each have a deformed U-shape having portions disposed inside the coil 2 (middle portions 321), portions around which the coil 2 is not disposed (side base 322), portions protruding along a virtual surface 20 (FIG. 2) including end surfaces 2*e* of the coil 2 (side extension portions 3223), and a portion protruding in the axial direction of the coil 2 away from the coil 2 (a central protruding portion 3225). Hereinafter, a reactor will be described in detail. Note that in FIGS. 1, 3 to 5, and 7 to 10 that will be described later, the side base 322 is cross-hatched with long-short-short-dashed line for easy understanding. In FIG. 1, the portion of the side base 322 that overlaps with the central protruding portion 3225 is not cross-hatched. In FIGS. 3 and 8, a lower surface 32*d* is hatched in the form of grid with broken lines.

Coil

Figure 2:
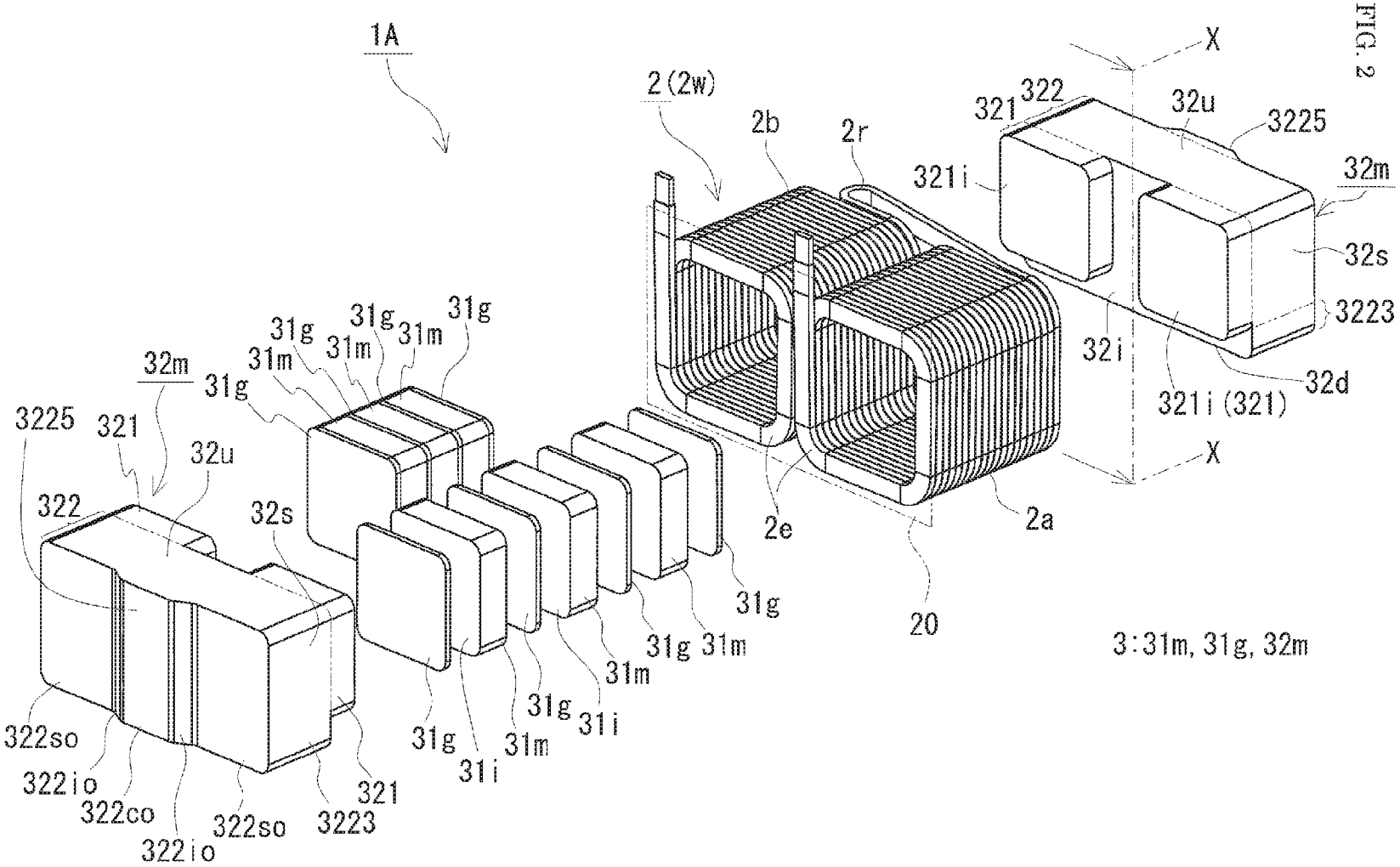
FIG. 2 is an exploded perspective view showing a reactor of Embodiment 1.
Figure 3:
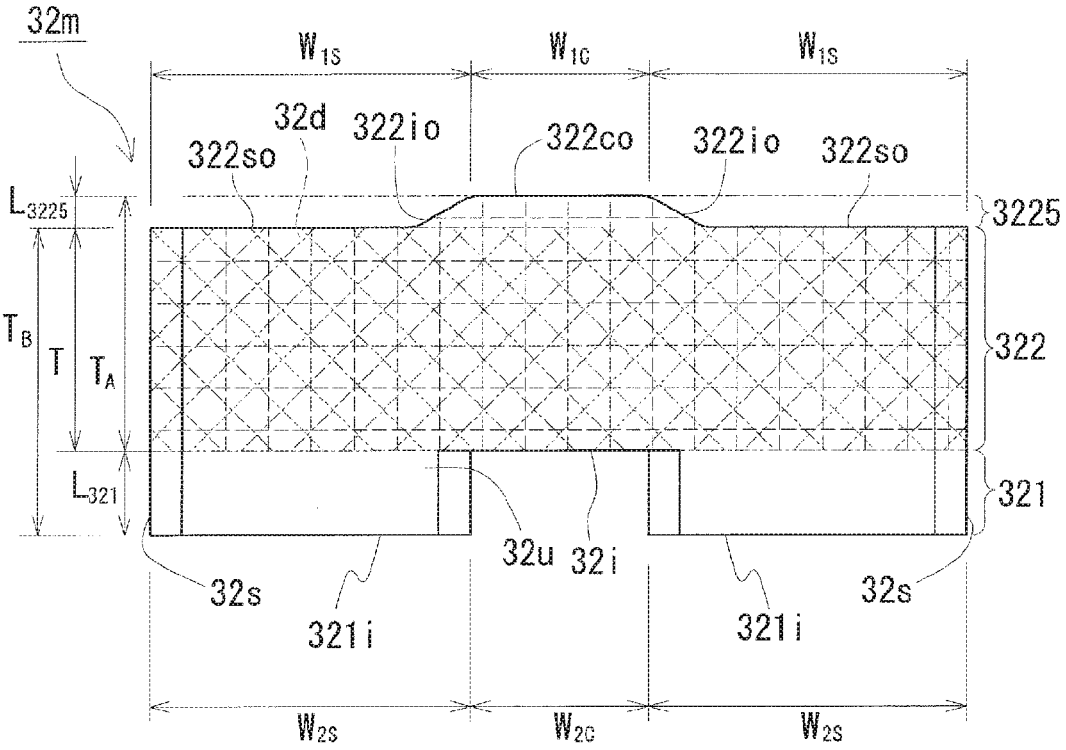
FIG. 3 is a plan view of a U-shaped core piece provided in the reactor of Embodiment 1.

As shown in FIGS. 1 and 2, the coil 2 includes a pair of tubular (square tubular shape having round corners, here) winding portions 2*a* and 2*b* formed by helically winding one continuous winding wire 2*w*, and a connection portion 2*r* that is formed by a portion of the winding wire 2*w* and connects the two winding portions 2*a* and 2*b*. The winding portions 2*a* and 2*b* are arranged side by side (in parallel with each other) such that the axial directions are parallel with each other. In this example, the winding wire 2*w* is a covered flat wire (so-called enameled wire) including a conductor made from a flat wire (copper or the like) and an insulating coating (polyamide imide or the like) for covering the outer circumference of this conductor, and the winding portions 2*a* and 2*b* are edgewise coils. Both of the two end portions of the winding wire 2*w* are led out from the winding portions 2*a* and 2*b* in appropriate directions, and terminal metal fittings (not shown) are connected to their tips (conductors). The coil 2 is electrically connected to an external apparatus (not shown) such as a power source, via the terminal metal fittings.

Magnetic Core

As shown in FIGS. 1 and 2, the magnetic core 3 includes a plurality of columnar core pieces 31*m*, . . . , a pair of U-shaped core pieces 32*m* and 32*m*, and gaps (gap members 31*g*, here) that are interposed between the pieces. The core pieces 32*m* and 32*m* are disposed such that the opening portions of the U-shape face each other, and the core pieces 31*m* and the gap members 31*g* are disposed between the core pieces 32*m* and 32*m*. More specifically, in the magnetic core 3, the core pieces 31*m* and 32*m* are attached in the annular form, sandwiching a columnar stacked article including the core pieces 31*m* between the middle portions 321 and 321 included in one U-shaped core piece 32*m* and the middle portions 321 and 321 included in another U-shaped core piece 32*m*, and when the coil 2 is excited, a closed magnetic circuit is formed.

Material

In this example, both core pieces 31*m* and 32*m* are powder compacts. Typically, the powder compact is obtained by forming a base powder including powder of a soft magnetic metal such as iron or an iron alloy (Fe—Si alloy, Fe—Ni alloy, or the like), a binder (resin or the like), and a lubricant as appropriate, and then subjecting the formed base powder to heat treatment for removal of warping caused by molding. The powder compact is obtained using, as the base powder, covered powder obtained by subjecting metal powder to insulation treatment, and mixed powder obtained by mixing metal powder and an insulating material, the powder compact being substantially constituted by metal particles and the insulating material interposed between the metal particles, after molding. This powder compact contains the insulating material, and thus can reduce eddy currents and has low loss. Typically, a metal mold including a die having through-holes, an upper punch and a lower punch that are inserted into the through-holes and press the base powder is utilized for the above-described molding. Details of the molding of the U-shaped core piece 32*m* will be described later.

U-Shaped Core Piece

Figure 4:
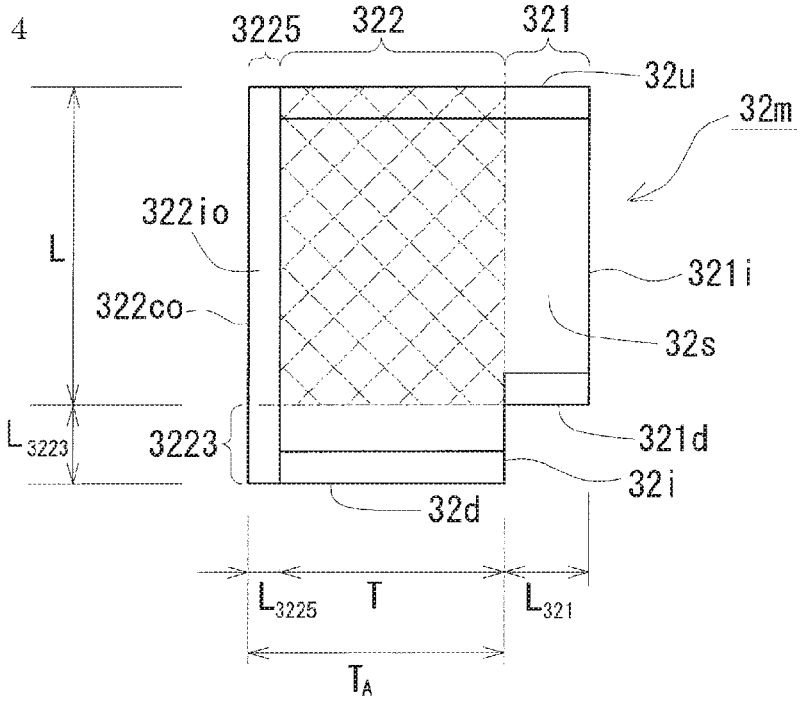
FIG. 4 is a side view of the U-shaped core piece provided in the reactor of Embodiment 1.
Figure 5:
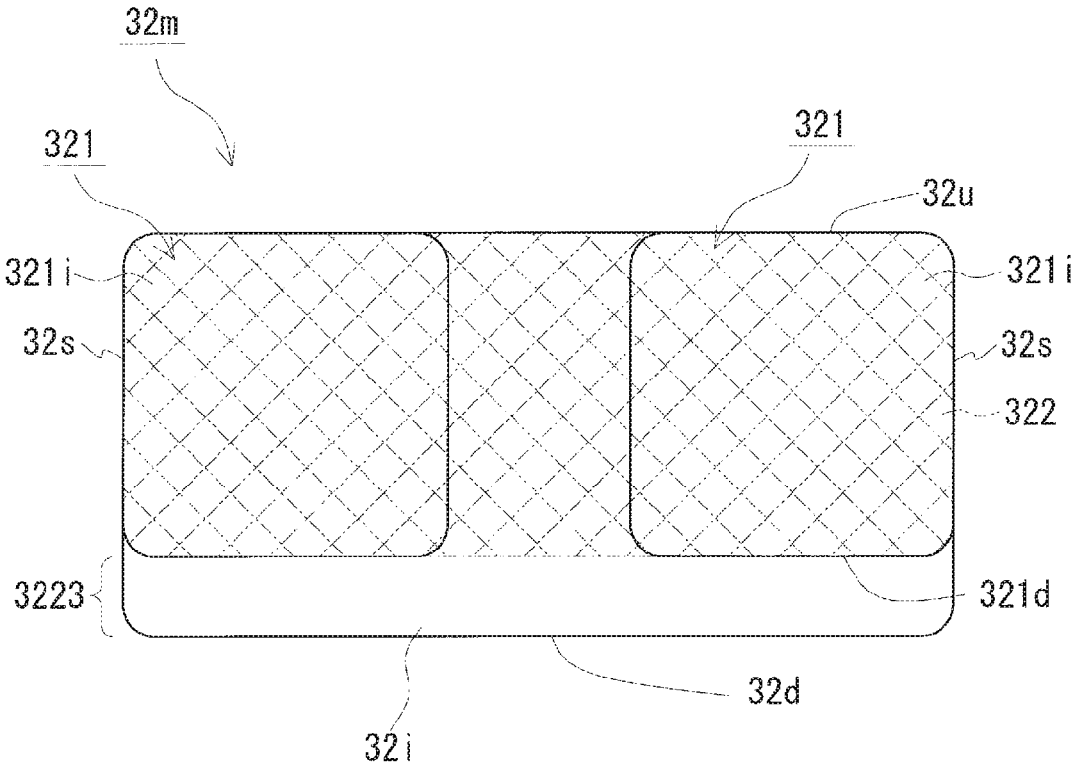
FIG. 5 is a front view of the U-shaped core piece provided in the reactor of Embodiment 1.

The U-shaped core pieces 32*m* and 32*m* have the same shape, and have a U-shape in the plan view (FIG. 3), and a rectangular shape in the front view (FIG. 5). Specifically, as shown in FIG. 1, the core piece 32*m* includes a side base 322 that is not covered by the winding portions 2*a* and 2*b* of the coil 2, and is disposed across the pair of winding portions 2*a* and 2*b* of the coil 2, and a pair of middle portions 321 and 321 protruding from the side base 322 so as to be disposed inside the pair of winding portions 2*a* and 2*b*. This aspect is similar to a conventional U-shaped core piece having a U-shape in the plan view, a cuboidal shape in the front view and side view, that is, the thickness and the height of the core piece are uniform over the full length of the U shape. Furthermore, the core piece 32*m* is disposed such that the side base 322 is opposite to a virtual surface 20 (FIG. 2) including the end surfaces 2*e* and 2*e* of the winding portions 2*a* and 2*b*, and have portions opposite to the end surfaces 2*e* and 2*e*. Also, the core piece 32*m* has a F shape in the side view (FIG. 4), and the lower surfaces 32*d* protrude from the lower surfaces 321*d* of the middle portions 321 and 321. As shown in FIGS. 1 to 3, in the core piece 32*m*, a portion of the outer end surface protrudes in a direction opposite to the direction in which the middle portion 321 protrudes. More specifically, the core piece 32*m* includes the side extension portions 3223 extending from the side base 322 in a direction intersecting the axial direction of the middle portion 321, and the central protruding portion 3225 protruding from the central region of the side base 322, with respect to the direction in which the pair of middle portions 321 and 321 are arranged side by side (the horizontal direction in FIG. 3. Hereinafter, this is also simply referred to as "middle portion line-up direction"), away from the middle portion 321.

As shown in FIG. 3, in the plan view, the contour of the U-shaped core piece 32*m* on the side closer to the coil 2 (inner side, lower side in FIG. 3) has a shape whose central region is recessed upward. On the other hand, the contour on the side away from the coil 2 (outer side, upper side in FIG. 3) has a shape whose central region protrudes upward. That is, it can be said that a recess of the contour on the inner side of the core piece 32*m* appears as a protruding portion of the contour on the outer side, and the contour on the inner side and the contour on the outer side correspond to each other.

Side Base

The side base 322 serves as a virtual region having a cuboidal shape (a portion cross-hatched with long-short-short-dashed line in FIGS. 1, 3 to 5). In this example, the side base 322 includes, as the outer circumferential surfaces, an upper surface 32*u*, a pair of side surfaces 32*s* and 32*s*, an inner end surface 32*i* (FIGS. 2 to 5) opposite to the end surfaces 2*e* and 2*e* of the winding portions 2*a* and 2*b* of the coil 2, and outer edge surfaces 322*so* opposite to the end surfaces 321*i* and 321*i* of the middle portions 321 and 321. The upper surface 32*u* of the core piece 32*m* is a deformed U-shaped flat surface (FIG. 3), the side surface 31*s* is a F-shaped flat surface (FIG. 4), the inner end surface 32*i* has an inverse-T shaped flat surface (FIG. 5), and the outer edge surface 322*so* is a rectangular flat surface. The side surfaces 32*s*, the inner end surface 32*i*, and the outer edge surfaces 322*so* are orthogonal to the upper surface 32*u*. The inner end surface 32*i* and the outer edge surfaces 322*so* are parallel with the end surfaces 2*e* and 2*e* (the virtual surface 20 (FIG. 2)) of the winding portions 2*a* and 2*b*. This inner end surface 32*i* is a portion opposite to the end surfaces 2*e* and 2*e*.

Middle Portion

The middle portions 321 and 321 are cuboidal portions (FIG. 2) each having an end surface 321*i* that is part of a flat surface having a rectangular shape in the front view (FIG. 5), and are apart from each other on the side base 322, sandwiching the central region in the middle portion line-up direction (FIGS. 2, 3, and 5).

The size of the end surface 321*i* of the middle portions 321 can be selected as appropriate so as to have a predetermined magnetic path cross-sectional area corresponding to the coil 2. Also, the shape of the end surface 321*i* can be changed as appropriate in accordance with the shape of the inner circumference of the coil 2 (the winding portions 2*a* and 2*b*), and may be circular, for example. In this example, all four corners of the rectangular end surface 321*i* are rounded similarly to the shape of the inner circumference of the winding portions 2*a* and 2*b*. That is, all of the four corners are subjected to R-chamfering (rounded). The end surface 321*i* is a surface facing the gap members 31*g* disposed between the core pieces 32*m* and 31*m* (FIG. 2).

A length $L_{321}$ of the middle portion 321 protruding from the side base 322 (the length along the axial direction of the middle portion 321. FIGS. 3 and 4) can be selected as appropriate. In particular, it is preferable to select the protruding length $L_{321}$ of the middle portion 321 in such a range that a specific relationship (thickness ratio $T_A/T_B$ (FIG. 3) is 0.5 to 2), which will be described later, is satisfied.

Side Extension Portion

In this example, the side extension portion 3223 extends in that direction intersecting the axial direction of the coil 2 (the winding portions 2*a* and 2*b*) that is a direction toward the installation target (downward, here) (FIGS. 1, 4, and 5). The U-shaped core piece 32*m* uses the lower surface 32*d* of this side extension portion 3223 that is opposite to the installation target as the installation surface.

The length $L_{3223}$ of the side extension portion 3223 protruding from the side base 322 (in this example, this is, the length in the direction toward the installation target, and is equal to a length from the lower surface 321*d* to the lower surface 32*d* of the middle portion 321. FIG. 4) can be selected as appropriate. If a total magnetic path cross-sectional area, which will be described later, is constant, the longer the protruding length $L_{3223}$ is, the more easily the thickness $T_A$ of the central region (FIG. 3, details will be described later) can be reduced, and thus the installation area of the U-shaped core piece 32*m* (here, the area of the lower surface 32*d*) can be reduced. If the protruding length $L_{3223}$ of the side extension portion 3223 is too long, the thickness $T_A$ is too thin to perform molding, an installation state becomes unstable, and its heat releasing capability does not sufficiently increase. Examples of the protruding length $L_{3223}$ of the side extension portion 3223 is roughly at least 10% and not more than 100%, roughly at least 10% and not more than 70%, and at least 10% and not more than 50% of the length L of the middle portion 321. In this example, the protruding length $L_{3223}$ of the side extension portion 3223 is about 25% of the length L of the middle portion 321.

As shown in FIG. 4, it is preferable that the side extension portion 3223 has the same thickness as a thickness T of the side base 322 (the length along the axial direction of the middle portion 321), and is provided over the entire region from one side surface 32*s* to the other side surface 32*s*. In this case, the thickness T of the side base 322 can be easily reduced due to the side extension portion 3223 having a sufficiently large volume. As a result, the installation area of the reactor 1A can be reduced easily.

Central Protruding Portion

The central protruding portion 3225 is located in the central region in the middle portion line-up direction of the side base 322, more specifically, is located partially opposite to a region sandwiched by the pair of middle portions 321 and 321 of the inner end surface 32*i* (FIG. 2). Also, the central protruding portion 3225 is opposite to a region adjacent to the end surfaces 2*e* and 2*e* of the winding portions 2*a* and 2*b* of the coil 2. Unlike the middle portion 321 that is present only in a portion of the side base 322 in the front view, this central protruding portion 3225 is continuously present over the full length from the upper surface 32*u* to the lower surface 32*d* in the rear view (FIGS. 1 and 4).

The central protruding portion 3225 has a trapezoidal shape in the plan view (FIG. 3) in this example, is opposite to the inner end surface 32*i*, and includes a central outer end surface 322*co* that is part of a flat surface parallel with the direction in which the pair of middle portions 321 and 321 are arranged side by side (line-up direction), and two inclined surfaces 322*io* and 322*io* connecting the above-described outer edge surfaces 322*so* and the central outer end surfaces 322*co*. The shape of a flat surface of the central protruding portion 3225 can be changed as appropriate, and may be a rectangular shape, for example. In this example, the central protruding portion is formed into a trapezoidal shape by C-chamfering its rectangular shape, and the inclined surface 322*io* is formed by C-chamfering. Also, in this example, corners between the central outer end surface 322*co* and the inclined surfaces 322*io*, and corners between the inclined surfaces 322*io* and the outer edge surfaces 322*so* are subjected to R-chamfering.

The length $L_{3225}$ of the central protruding portion 3225 protruding from the side base 322 (in this example, this is a length in a direction away from the coil 2 along the axial direction of the middle portion 321, and is equal to a distance between the central outer end surface 322*co* and the outer edge surface 322*so*. FIGS. 3 and 4) can be selected as appropriate. In particular, it is preferable to select the protruding length $L_{3225}$ of the central protruding portion 3225 in such a range that a specific relationship (a thickness ratio $T_A/T_B$ (FIG. 3) is 0.5 to 2), which will be described later, is satisfied.

Corner

In the U-shaped core piece 32*m* shown in FIG. 1, the above-described four corners of the middle portion 321, the corners of the central protruding portion 3225, corners between the upper surface 32*u* and the side surfaces 32*s* (including upper outer corners of the middle portions 321 and 321), and corners between the lower surface 32*d* and the side surfaces 32*s* are subjected to R-chamfering. C-chamfering may be performed instead of R-chamfering, or R-chamfering and C-chamfering may be omitted. A radius for R-chamfering and a length of a side that is cut off by C-chamfering can be selected as appropriate in such a range that a volume of the core piece 32*m* is not excessively reduced. For example, the radius for R-chamfering may be roughly at least 0.5 mm and not more than 5 mm, or roughly at least 2 mm and not more than 4 mm, and the length of a side that is cut off by C-chamfering may be roughly at least 0.5 mm and not more than 5 mm, or roughly at least 2 mm and not more than 4 mm.

Size

Magnetic Path Cross-Sectional Area

The sizes of the side extension portion 3223 and the central protruding portion 3225 are set such that a total magnetic path cross-sectional area of the side base 322, the side extension portion 3223, and the central protruding portion 3225 is greater than or equal to the magnetic path cross-sectional area of the middle portion 321 (is equal to an area of the end surface 321*i*, here). Specifically, a cross-sectional area (total magnetic path cross-sectional area) obtained by cutting a location including the side base 322, the side extension portions 3223, and the central protruding portion 3225 with an X-X cutting line (a cutting line in a direction orthogonal to the magnetic flux of the coil 2) shown in FIG. 2 is designed such that the total magnetic path cross-sectional area is equal to the magnetic path cross-sectional area of the middle portion 321, or slightly larger than the magnetic path cross-sectional area of the middle portion 321. In this example, the total magnetic path cross-sectional area is slightly larger.

Thickness

As shown in FIG. 3, if a sum of the length (thickness T) of the side base 322 along the axial direction of the middle portion 321 and the protruding length $L_{3225}$ of the central protruding portion 3225 is a thickness $T_A$, and a sum of the protruding length $L_{321}$ of the middle portion 321 and the thickness T of the side base 322 is a thickness $T_B$, then the thickness ratio $T_A/T_B$ is preferably at least 0.5 and not more than 2. As described later, when the U-shaped core piece 32*m* is molded, if the axial direction of the middle portion 321 is a pressing direction during molding, the end surfaces 321*i*, the outer end surfaces 322*so* and 322*co*, and the inclined surfaces 322*io* of the middle portion 321 can be formed into punch formed surfaces. In this case, compared to the case where a direction orthogonal to both the axial direction of the middle portion 321 and the middle portion line-up direction is a pressing direction, that is, the upper surface 32*u* and the lower surface 32*d* are punch formed surfaces, cracks of the side extension portion 3223 and insufficient pressing can be prevented, and therefore the U-shaped core piece 32*m* can be molded easily.

If the above-described thickness ratio $T_A/T_B$ is too small or too large, that is, if there is an excessively large difference between the thickness $T_A$ of the central region of the U-shaped core piece 32*m* and the thickness $T_B$ of the left and right regions sandwiching the central region, as described later, in the case where the axial direction of the middle portion 321 is a pressing direction, a pressing force in molding is likely to be ununiform. Specifically, a thin portion is pressed excessively, or a thick portion is pressed with an insufficient pressing force. As a result, the core piece 32*m* may partially have a difference in density. If this difference in density is too large, a portion having a low density may be cracked, or a border between a high density region and a low density region may be cracked. If the thickness ratio $T_A/T_B$ is at least 0.5 and not more than 2, a difference in density caused by variation in the pressing force applied when such a powder compact is molded is reduced, for example, and a core piece 32*m* having a uniform density can be stably manufactured with ease. It is preferable that the thickness ratio $T_A/T_B$ is at least 0.6 and not more than 1.7, at least 0.7 and not more than 1.4, at least 0.8 and not more than 1.25, and a value closer to 1 is more preferable. Here, the thickness ratio $T_A/T_B$ is about 0.83.

Width

It is assumed that a length from the side surface 32*s* of the side base 322 to the side edge of the central protruding portion 3225 (the side edge of the central outer end surface 322*co*, here) along the direction in which the pair of middle portions 321 and 321 are arranged side by side (line-up direction) is a width $W_{1S}$, and a length of the central outer end surface 322*co* of the central protruding portion 3225 is a width $W_{1C}$. It is assumed that a length of the middle portion 321 along the above-described line-up direction is a width $W_{2S}$, and a length between the pair of middle portions 321 and 321 along the above-described line-up direction is a width $W_{2C}$. At this time, it is preferable that a ratio of the inner and outer widths $(W_{1S}/W_{1C})/(W_{2S}/W_{2C})$ is at least 0.8 and not more than 1.25. Furthermore, it is more preferable that both the ratio of the left and right widths $(W_{1S}/W_{2S})$ and the ratio of the central widths $(W_{1C}/W_{2C})$ are at least 0.8 and not more than 1.25. In this example, the width $W_{1S}$ indicates a length to the side edge of the central outer end surface 322*co*, and includes an inclined portion covered by the inclined surface 322*io*.

In the U-shaped core piece 32*m*, if the ratio of the inner and outer widths $(W_{1S}/W_{1C})/(W_{2S}/W_{2C})$ is at least 0.8 and not more than 1.25, as described above, it can be said that the inner contour and the outer contour of the core piece 32*m* are very similar to each other In such a core piece 32*m*, as described later, if the axial direction of the middle portion 321 is a pressing direction in molding, the central region and the left and right regions can be uniformly pressed with ease, and the core piece 32*m* can be molded to have a precise shape and size. Also, since the central region and the left and right regions can be pressed uniformly, a difference in density between the central region and the left and right regions can be reduced, for example, and the core piece 32*m* can be produced with excellent productivity. Furthermore, the ratio of the left and right widths $(W_{1S}/W_{2S})$, and the ratio of the central widths $(W_{1C}/W_{2C})$ are at least 0.8 and not more than 1.25, and thus the inner contour and the outer contour of the core piece 32*m* are more likely to be equal to each other, and a core piece 32*m* having excellent shape accuracy and dimensional accuracy can be molded. Because the core piece 32*m* has a specific shape, namely, a deformed U-shape, and such a core piece 32*m* constitutes a powder compact, it is proposed that the above-described thickness ratio and width ratio are in specific ranges, considering its moldability.

It is preferable that all of the ratio of the inner and outer widths $(W_{1S}/W_{1C})/(W_{2S}/W_{2C})$, the ratio of the left and right widths $(W_{1S}/W_{2S})$, and the ratio of the central widths $(W_{1C}/W_{2C})$ are at least 0.5 and not more than 2, at least 0.6 and not more than 1.7, and at least 0.7 and not more than 1.4, and a value closer to 1 is more preferable. Here, all of the ratio of the inner and outer widths $\{(W_{1S}/W_{1C})/(W_{2S}/W_{2C})\}$, the ratio of the left and right widths $(W_{1S}/W_{2S})$, and the ratio of the central widths $(W_{1C}/W_{2C})$ are 1.

Manufacturing Method

A method for manufacturing the U-shaped core piece 32*m* will be described with reference to FIG. 6.

A metal mold 100 is used that includes a die 110 having a through-hole 110*h*, a lower punch 113 that is inserted into the die 110 and has a pressing surface 113*u* for forming a space to which a base powder P is supplied, together with the inner circumferential surface of the through-hole 110*h*, and an upper punch 112 that includes a pressing surface 112*d* pressing the base powder P together with the lower punch 113.

A specific shape of the metal mold 100 shown in this example will be described.

A planar shape of the inner circumference of the through-hole 110*h* is a rectangular shape with round corners similarly to the front shape (FIG. 5) of the U-shaped core piece 32*m*. Of the inner circumferential surface of the through-hole 110*h*, the upper surface 32*u*, the lower surface 32*d*, and the side surfaces 32*s* whose planar portions are plane surfaces are formed, and corners (R-chamfered portions, here) connecting two types of surfaces 32*u* and 32*s* and surfaces 32*d* and 32*s* whose round corners are orthogonal to each other are formed.

The pressing surface 112*d* of the upper punch 112 is a surface forming the outer end surface of the U-shaped core piece 32*m*, and is a rectangular surface with round corners corresponding to the shape of the outer end surface. A central portion of this rectangular shaped surface has a recess whose bottom is a flat surface. Two portions sandwiching the recess of the pressing surface 112*d* are also flat surfaces, and portions at which the recess and the flat surfaces are connected to each other are inclined. The planar portion of the recess forms the central outer end surface 322*co*, and the planar portions of the two portions sandwiching the recess form the outer edge surfaces 322*so* and

322*so*, and the inclined portions form the inclined surfaces 322*io* and 322*io*. It is possible to manufacture the core piece 32*m* having a partially protruding portion (the central protruding portion 3225) of the outer end surface due to the upper punch 112 having the recess.

Figure 6:
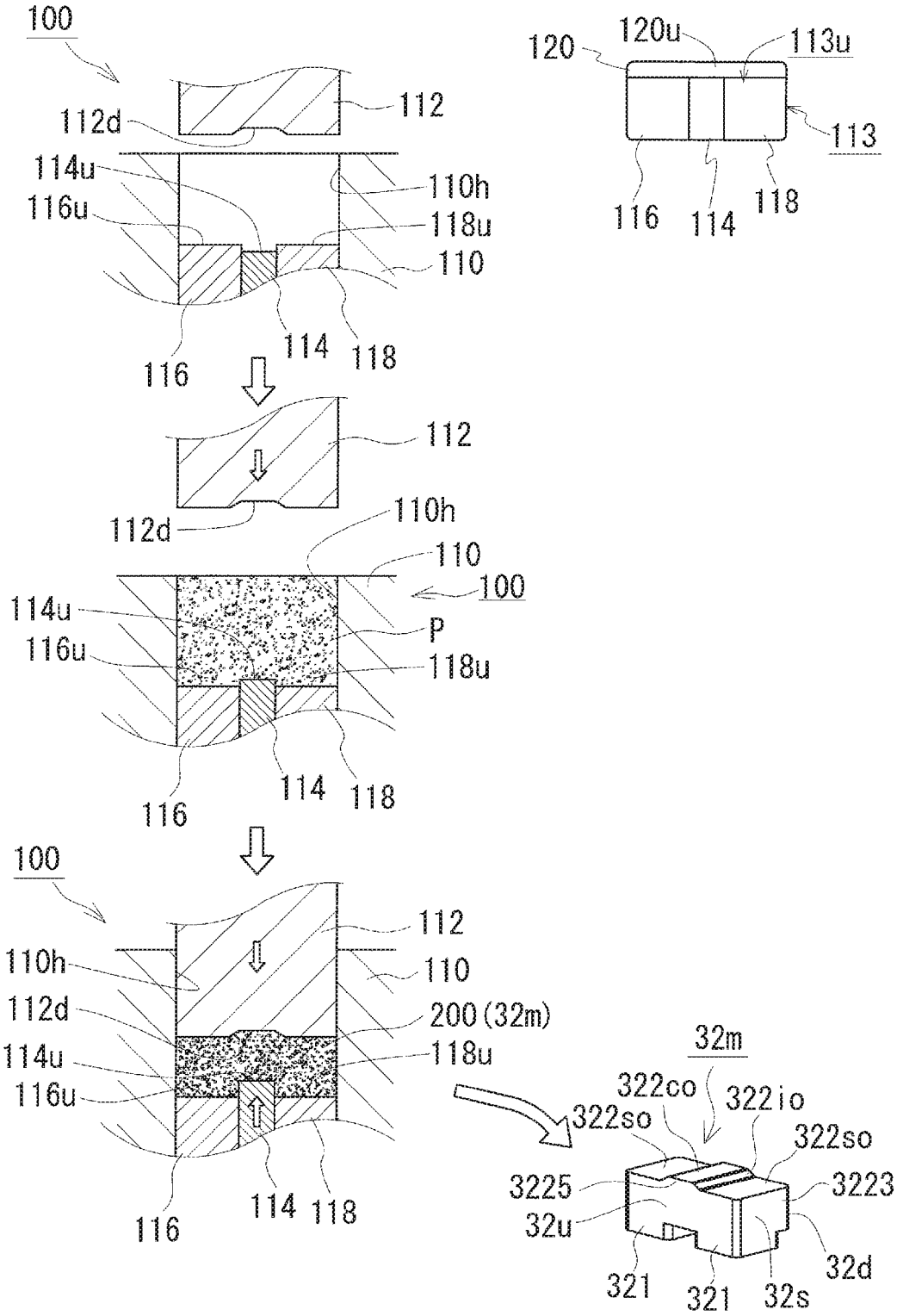
FIG. 6 is a process illustration diagram illustrating a process of manufacturing the U-shaped core piece provided in the reactor of Embodiment 1.

As shown in the upper right plan view in FIG. 6, the lower punch 113 is used in a combination of a plurality of punches. Specifically, used are four lower punches 114 to 120 in total, namely, in combination, the lower punches 114 and 120 that are respectively provided with rectangular pressing surfaces 114*u* and 120*u* for forming the inner end surface 32*i* (FIG. 5) having an inversed T shape, and lower punches 116 and 118 that are respectively provided with rectangular pressing surfaces 116*u* and 118*u* for forming the end surfaces 321*i* and 321*i* (FIG. 5) of the middle portions 321 and 321. The lower punches 114 to 120 are mutually movable, and it is possible to manufacture a core piece 32*m* having portions (the middle portions 321 and 321) that partially protrude from the inner end surfaces 32*i* by adjusting the positions of the lower punches. Also, it is possible to manufacture a core piece 32*m* having a portion (the side extension portion 3223) extending along both the outer end surface and the inner end surface 32*i* with the two punches 112 and 113.

Next, a specific procedure will be described.

As shown at the top of FIG. 6, the lower punch 113 is inserted into the through-hole 110*h* to form a powder supply space, and the powder supply space is filled with the base powder P. The position of the lower punch 113 is adjusted such that the core piece 32*m* and the powder supply space have a similar shape. Here, as shown at the middle of FIG. 6, the powder supply space is filled with the base powder P by allowing the pressing surfaces 114*u* and 120*u* of the lower punches 114 and 120 to protrude upward from the pressing surfaces 116*u* and 118*u* of the lower punches 116 and 118, and the surface of the base powder P is made flat.

When the powder supply space is filled with the base powder P, as shown at the bottom of FIG. 6, the upper punch 112 is inserted into the through-hole 110*h* of the die 110, and the base powder P is compressed with the two punches 112 and 113 while adjusting the position of the lower punch 113 (114 to 120). When a distance between the recess of the pressing surface 112*d* of the upper punch 112 and the pressing surfaces 114*u* and 120*u* of the lower punches 114 and 120 that are disposed in the inversed-T shape is $T_a$, and distances between the two side portions of the recess of the pressing surface 112*d* of the upper punch 112 and the pressing surface 116*u* and 118*u* of the lower punches 116 and 118 are respectively $T_b$ and $T_b$, the position of the lower punch 113 (114 to 120) is adjusted such that the ratio $T_a/T_b$ of thicknesses of the base powder P is equal to or approximately equal to a predetermined thickness ratio $T_A/T_B$. Doing so makes it possible to suppress a situation where the degree of compression in the central region in the core piece 32*m* and the degree of compression in the left and right regions are likely to be equal to each other, and a compact 200 may have a difference in its density. The core piece 32*m* (before heat treatment) having a deformed U-shape can be obtained by removing the compact 200 from the die 110.

Core Piece 31*m*

As shown in FIG. 2, the core pieces 31*m* all have the same shape, and have a rectangular shape having the end surface 31*i* having the same shape as the end surface 321*i* of the middle portion 321 of the U-shaped core piece 32*m* in this example. Similarly to the end surface 321*i* of the core piece 32*m*, the end surface 31*i* of the core piece 31*m* is a surface facing the gap members 31*g*.

Gap

The gap members 31*g* are made of a material having a relative magnetic permeability lower than that of the core pieces 31*m* and 32*m*, and typically, is made of a non-magnetic material such as alumina. In this example, the gap members 31*g* are flat plates that have a rectangular shape in the plan view and are made of a non-magnetic material. The number of core pieces 31*m* and gap members 31*g*, and the shape of the gap members 31*g* can be selected as appropriate. An air gap can be used instead of the gap members 31*g*, or in combination with the gap members 31*g*.

In the reactor 1A, the magnetic core 3 includes at least one gap, and is disposed between cores. That is, the gap is disposed between the core pieces 31*m* and 32*m*, or between the core pieces 31*m* and 31*m*. Therefore, in the reactor 1A, the gap is disposed inside the winding portions 2*a* and 2*b* of the coil 2.

Functional Effects

The reactor 1A of Embodiment 1 has a small installation area, low loss, and excellent productivity due to usage of specific U-shaped core pieces 32*m* as constituent elements. Specifically, the reason is as follows.

Since the U-shaped core piece 32*m* integrally includes the side extension portion 3223 protruding from the side base 322 in a direction orthogonal to the axial direction of the middle portion 321 (the winding portions 2*a* and 2*b* of the coil 2), that is, a direction toward the installation target, the length (the thickness $T_A$) along the axial direction of the winding portions 2*a* and 2*b* can be reduced. The reactor 1A has a small protruding portion along the axial direction of the coil 2 and has a small installation area due to usage of one surface (here, the lower surface 32*d*) of this thin side extension portion 3223 as the installation surface of the reactor 1A.

The U-shaped core piece 32*m* integrally includes the pair of middle portions 321 and 321 that protrude from the side base 322, and the end surfaces 321*i* and 321*i* facing the gap (the gap members 31*g*) provided between the core pieces can be disposed inside the winding portions 2*a* and 2*b* of the coil 2. That is, in the reactor 1A, the gap can be disposed inside the winding portions 2*a* and 2*b*. Therefore, in the reactor 1A, compared to the case where there is a gap at the border between a portion disposed inside the coil and a portion that is not covered by the coil in the magnetic core, losses are not caused by magnetic flux leaking from the gap at this border, and thus the reactor 1A has low loss.

The U-shaped core piece 32*m* integrally includes the side base 322 disposed outside the coil 2 and the pair of middle portions 321 and 321 disposed inside the coil 2, and thus has a small number of assembling components, and the number of steps can be reduced. Also, in the reactor 1A, since the gap can be disposed inside the winding portions 2*a* and 2*b* of the coil 2 as described above, a specific gap member for reducing magnetic flux leaking from the gap at the above-described border can be omitted. In these respects, the reactor 1A has excellent productivity.

In particular, the U-shaped core piece 32*m* includes the central protruding portion 3225, and thus the thickness $T_A$ of the central region and the thickness $T_B$ of the left and right regions can be easily made equal to each other. As a result, as described above, if the core piece 32*m* is molded using the axial direction of the middle portion 321 as the pressing direction, it is possible to reduce a difference in density between the above-described regions, and easily mold the core piece 32*m* in a uniform density over the entire core piece 32*m*. Also, although the middle portions 321 and 321 and the central protruding portion 3225 are located in parallel with the axial direction of the middle portion 321, the side extension portion 3223 is orthogonal to the axial direction of the middle portion 321. That is, the core piece 32*m* has a deformed shape having portions protruding from the side base 322 in multiple directions. Although the core piece 32*m* has such a complicated three-dimensional shape, as described above, it is possible to stably manufacture the core piece 32*m* with precision using the axial direction of the middle portion 321 as the pressing direction, and the metal mold 100 having a specific shape. In these respects, the reactor 1A has excellent productivity.

Furthermore, in the reactor 1A, the inclined surfaces 322*io* and the like are subjected to C-chamfering, and corners are subjected to R-chamfering. Therefore, when a deformed U-shaped core piece 32*m* is molded, compared to a core piece having a sharp angle such as a right angle, it is easy to prevent cracking when the core piece is removed from the metal mold or when the core piece is attached to the coil 2, for example. In these respects as well, the reactor 1A has excellent productivity.

Moreover, in the reactor 1A, using a portion of the magnetic core 3 (the lower surfaces 32*d* and 32*d* of a pair of the U-shaped core pieces 32*m* and 32*m*) as the installation surface can increase the stability of being attached to the installation target, and increase its heat releasing capability.

Embodiment 2

A reactor 1B of Embodiment 2 will be described with reference to FIGS. 7 to 10. A basic configuration of the reactor 1B is similar to that of the reactor 1A of Embodiment 1, and includes a coil 2 and a magnetic core 3. The magnetic core 3 includes deformed U-shaped core pieces 32*m* and 32*m* protruding in multiple directions, as well as core pieces 31*m* and gap members 31*g* that are disposed between the core pieces 32*m* and 32*m* (FIGS. 1 and 2). In particular, the core pieces 32*m* included in the reactor 1B differ from Embodiment 1 in the way that their side extension portion protrude. Hereinafter, this difference will be described in detail, and the description of other configurations is omitted.

In the reactor 1A of Embodiment 1, the side extension portion 3223 extends only toward the installation target (downward in FIG. 1). In the reactor 1B of Embodiment 2, the U-shaped core piece 32*m* has portions that respectively extend from the side base 322 in a direction toward the installation target and a direction away from the installation target. Specifically, as shown in FIGS. 7, 9 and 10, the core piece 32*m* includes a lower side extension portion 3223*d* that protrudes from the side base 322 in a direction orthogonal to the axial direction of the middle portion 321 (the axial direction of the winding portions 2*a* and 2*b* of the coil 2), that is, toward the installation target (here, downward), and an upper side extension portion 3223*u* that protrudes from the side base 322 away from the installation target (here, upward).

In the reactor 1B of Embodiment 2, since the side extension portion protrudes upward and downward, a length (a thickness $T_A$, FIGS. 8 and 9) along the axial direction of the winding portions 2*a* and 2*b* of the coil 2 in the U-shaped core piece 32*m* can be further reduced, further reducing the installation area.

Figure 9:
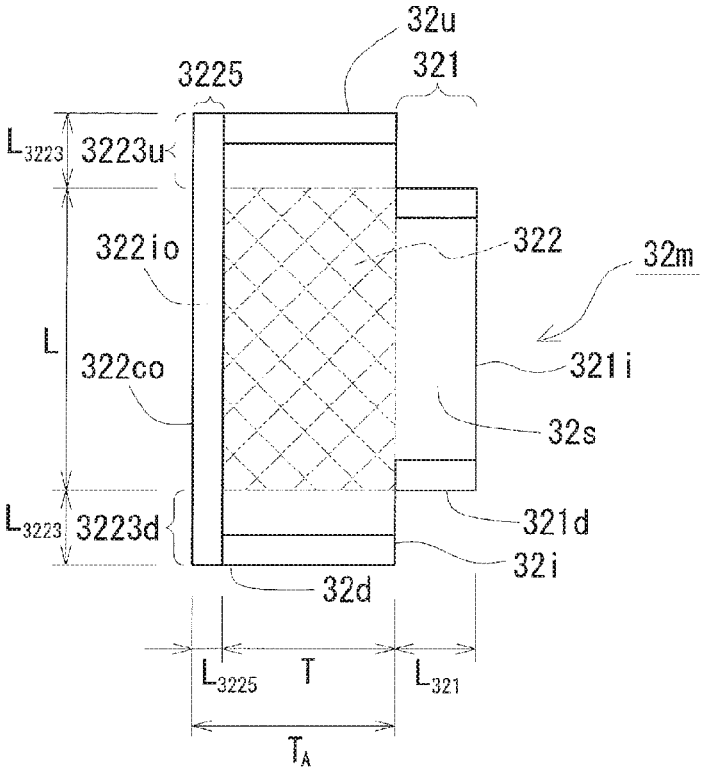
FIG. 9 is a side view of the U-shaped core piece provided in the reactor of Embodiment 2.
Figure 10:
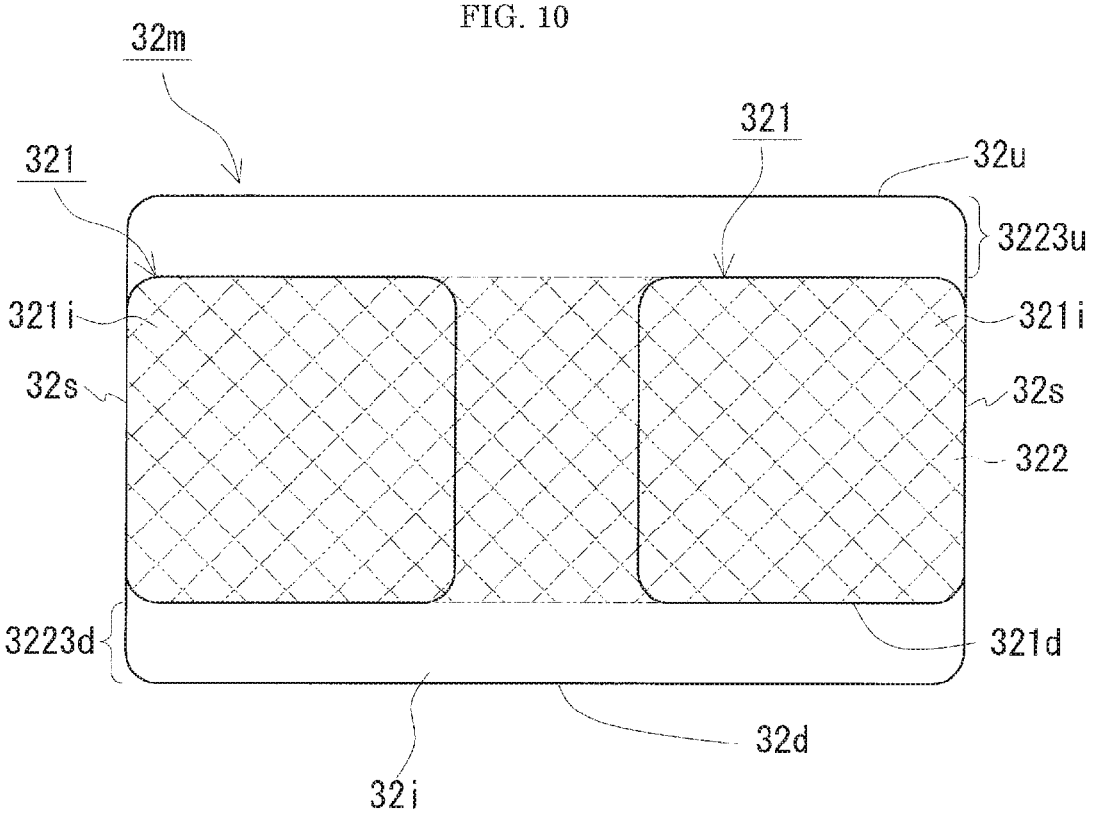
FIG. 10 is a front view of the U-shaped core piece provided in the reactor of Embodiment 2.

As shown in FIG. 9, a protruding length $L_{3223}$ of the lower side extension portion 3223*d* and a protruding length $L_{3223}$ of the upper side extension portion 3223*u* are equal to each other in this example, but they may be different from each other. Since the protruding lengths $L_{3223}$ and $L_{3223}$ are equal to each other, the U-shaped core piece 32*m* has an axisymmetric shape as shown in FIG. 10, and is easily molded, increasing its productivity. Also, although in this example, the core piece 32*m* includes the upper side extension portion 3223*u* and the lower side extension portion 3223*d* such that an upper surface 32*u* of the core piece 32*m* is substantially flush with an outer circumferential surface of the coil 2 (FIG. 7), an embodiment is possible in which the upper side extension portion 3223*u* protrudes from the outer circumferential surface of the coil 2. In this embodiment, the above-described thickness $T_A$ can be reduced further, and an installation area can be reduced further.

Note that in this example, a thickness ratio $T_A/T_B$ in the reactor 1B is 0.8, all of the ratio of inner and outer widths $\{(W_{1S}/W_{1C})/(W_{2S}/W_{2C})\}$, the ratio of left and right widths $(W_{1S}/W_{2S})$, and the ratio of central widths $(W_{1C}/W_{2C})$ are 1.

Such a U-shaped core piece 32*m* having the side extension portion 3223*u* and 3223*d* that extend upward and downward from the side base 322 can be manufactured using a plurality of lower punches for forming an H-shaped pressing surface, for example, instead of two lower punches 114 and 120 for forming the above-described pressing surface having an inversed-T shape.

Embodiment 3

In the reactor 1A of Embodiment 1, the side extension portion 3223 extends toward the installation target. But, an embodiment is also possible in which the side extension portion extends in a direction in which the pair of middle portions 321 and 321 are arranged side by side (a middle portion line-up direction). Briefly, referring to FIG. 1, in this embodiment, the extension portion extends in the left and right directions of the side base 322. In this embodiment, the length (a thickness $T_A$) along the axial direction of the winding portions 2*a* and 2*b* of the coil 2 in the U-shaped core piece can be reduced due to such a side extension portion extending in the left and right directions.

In particular, it is preferable that the length protruding from the side base 322 in a portion extending in the middle portion line-up direction is long enough to reach a virtual extension surface of the outer circumferential surface of the coil 2. That is, the above-described protruding length is adjusted such that the side surface of the U-shaped core piece and the outer circumferential surface of the coil are flush with each other. In this case, although the U-shaped core piece has a portion extending in the middle portion line-up direction, a size (width) along the middle portion line-up direction in the reactor can be similar to that in the reactor 1A of Embodiment 1 that does not have this portion.

Moreover, an embodiment is possible in which Embodiment 1 or Embodiment 2 described above is combined with Embodiment 3.

Other Configurations

The reactors 1A and 1B may include the following members. At least one of these members can also be omitted.

Sensor

The reactors 1A and 1B may include a sensor (not shown) for measuring a physical quantity of the reactors 1A and 1B or the like, such as a temperature sensor, an electrical current sensor, a voltage sensor, or a magnetic flux sensor.

Heat Dissipation Plate

The reactors 1A and 1B may include a heat dissipation plate (not shown) at any location on the outer circumferential surface of the coil 2. For example, if the installation surface (here, a lower surface) of the coil 2 is provided with the heat dissipation plate, heat of the coil 2 can be transferred well to the installation target such as a converter case via the heat dissipation plate, increasing its heat releasing capability. Materials having excellent heat conductivity, such as metal (e.g. aluminum or its alloy) or non-metal (e.g. alumina) can be used as the material for constituting the heat dissipation plate. The entire installation surface (here, a lower surface) of the reactors 1A or 1B may be provided with the heat dissipation plate. The heat dissipation plate may be fixed to a composition of the coil 2 and the magnetic core 3 by a joint layer, which will be described later, for example.

Joint Layer

At least an installation surface of the coil 2 (here, a lower surface) of the installation surfaces (here, lower surfaces) of the reactors 1A and 1B may be provided with the joint layer (not shown). If the installation target or the above-described heat dissipation plate is provided, the coil 2 can be strongly fixed to the heat dissipation plate due to the joint layer, and it is possible to restrict movement of the coil 2, improve its heat releasing capability and stability of being fixed to the installation target or the above-described heat dissipation plate, and the like. An insulating resin, in particular, an insulating resin that contains ceramics filler or the like and has excellent heat releasing capability (for example, its heat conductivity is at least 0.1 W/m·K, at least 1 W/m·K, and in particular, at least 2 W/m·K) is preferable as a material for constituting the joint layer. Examples of specific resins include thermosetting resins such as epoxy resins, silicone resins, and unsaturated polyesters, and thermoplastic resins such as polyphenylene sulfide (PPS) resins, and liquid crystal polymers (LCPs).

Insulating Member

The reactors 1A and 1B may include an insulating member (not shown) interposed between the coil 2 and the magnetic core 3. Examples of the insulating member include 1. molded parts such as bobbins, 2. winding layers such as insulating tape and insulating paper, 3. layers to which a resist such as varnish is applied, and 4. a molded portion obtained by molding an insulating resin with injection molding, for example, on at least one of the coil 2 and the magnetic core 3. Examples of a resin for constituting a bobbin or a molded portion include thermoplastic resins such as PPS resins, polytetrafluoroethylene (PTFE) resins, LCP, nylon 6, nylon 66, polybutylene terephthalate (PBT) resins. It is possible to increase insulation properties between the coil 2 and the magnetic core 3 due to the insulating member.

Note that the present invention is defined by the claims without being limited to these examples, and all modifications in the meaning and scope that are equivalent to the claims are intended to be included.

INDUSTRIAL APPLICABILITY

A reactor of the present invention is suitably used for in-vehicle converters (typically, DC-DC converters) installed in vehicles such as hybrid automobiles, plug-in hybrid automobiles, electric automobiles, and fuel cell automobiles, various converters such as converters of air conditioners, and constituent components of power conversion devices.

The invention claimed is:

1. A reactor comprising:

a coil having a pair of winding portions that are obtained by helically winding a winding wire and that are arranged side by side; and a magnetic core having a U-shaped core piece that is part of a powder compact, wherein the U-shaped core piece includes:

a side base that has a portion opposite to an end surface of the pair of winding portions, is not covered by the winding portions, and is disposed across the pair of winding portions;

a pair of middle portions that protrude from the side base to be respectively disposed inside the pair of winding portions, and have an end surface facing a gap;

a side extension portion extending from the side base in a direction intersecting an axial direction of the middle portions; and a central protruding portion that protrudes from the side base's central region, with respect to a direction in which the pair of middle portions are arranged side by side, away from the middle portions; and when a sum of a thickness of the side base along the axial direction of the middle portions and a protruding length of the central protruding portion is a thickness $T_A$, and a sum of a length protruding along the axial direction of the middle portions and the thickness of the side base is a thickness $T_B$, then a thickness ratio $T_A/T_B$ is at least 0.5 and not more than 2.

2. The reactor according to claim 1, wherein the side extension portion extends in that intersection direction that is a direction toward an installation target when the reactor is attached to the installation target, and a surface opposite to the installation target of the side extension portion serves as an installation surface.

3. The reactor according to claim 2, wherein the side extension portion also extends in that intersection direction that is a direction away from the installation target.

4. The reactor according to claim 1, wherein when a length extending from a side surface of the side base along the direction in which the pair of middle portions are arranged side by side to a side edge of the central protruding portion is a width $W_{1S}$, a length of a central outer end surface of the central protruding portion that is parallel with the direction in which the pair of middle portions are arranged side by side is a width $W_{1C}$, a length of each of the middle portions along the direction in which the pair of middle portions are arranged side by side is a width $W_{2S}$, and a length between the pair of middle portions along the direction in which the pair of middle portions are arranged side by side is a width $W_{2C}$, then a ratio of inner and outer widths $(W_{1S}/W_{1C})/(W_{2S}/W_{2C})$ is at least 0.8 and not more than 1.25.

5. The reactor according to claim 4, wherein both a ratio of left and right widths $(W_{1S}/W_{2S})$ and a ratio of central widths $(W_{1C}/W_{2C})$ are at least 0.8 and not more than 1.25.

6. The reactor according to claim 1, wherein at least one corner of the U-shaped core piece is subjected to R-chamfering or C-chamfering.

7. The reactor according to claim 2, wherein when a length extending from a side surface of the side base along the direction in which the pair of middle portions are arranged side by side to a side edge of the central protruding portion is a width $W_{1S}$, a length of a central outer end surface of the central protruding portion that is parallel with the direction in which the pair of middle portions are arranged side by side is a width $W_{1C}$, a length of each of the middle portions along the direction in which the pair of middle portions are arranged side by side is a width $W_{2S}$, and a length between the pair of middle portions along the direction in which the pair of middle portions are arranged side by side is a width $W_{2C}$, then a ratio of inner and outer widths $(W_{1S}/W_{1C})/(W_{2S}/W_{2C})$ is at least 0.8 and not more than 1.25.

8. The reactor according to claim 3, wherein when a length extending from a side surface of the side base along the direction in which the pair of middle portions are arranged side by side to a side edge of the central protruding portion is a width $W_{1S}$, a length of a central outer end surface of the central protruding portion that is parallel with the direction in which the pair of middle portions are arranged side by side is a width $W_{1C}$, a length of each of the middle portions along the direction in which the pair of middle portions are arranged side by side is a width $W_{2S}$, and a length between the pair of middle portions along the direction in which the pair of middle portions are arranged side by side is a width $W_{2C}$, then a ratio of inner and outer widths $(W_{1S}/W_{1C})/(W_{2S}/W_{2C})$ is at least 0.8 and not more than 1.25.

9. The reactor according to claim 2, wherein at least one corner of the U-shaped core piece is subjected to R-chamfering or C-chamfering.

10. The reactor according to claim 3, wherein at least one corner of the U-shaped core piece is subjected to R-chamfering or C-chamfering.

11. The reactor according to claim 4, wherein at least one corner of the U-shaped core piece is subjected to R-chamfering or C-chamfering.

12. The reactor according to claim 5, wherein at least one corner of the U-shaped core piece is subjected to R-chamfering or C-chamfering.

* * * * *